US008953993B2

(12) United States Patent
Tokuda et al.

(10) Patent No.: US 8,953,993 B2
(45) Date of Patent: Feb. 10, 2015

(54) FIXING DEVICE AND IMAGE FORMING APPARATUS INCORPORATING SAME

(75) Inventors: Tetsuo Tokuda, Kanagawa (JP); Masaaki Yoshikawa, Tokyo (JP); Kenji Ishii, Kanagawa (JP); Hiroshi Yoshinaga, Chiba (JP); Yuji Arai, Kanagawa (JP); Hiromasa Takagi, Tokyo (JP); Naoki Iwaya, Tokyo (JP); Yutaka Ikebuchi, Kanagawa (JP); Takuya Seshita, Kanagawa (JP); Ippei Fujimoto, Kanagawa (JP); Yoshiki Yamaguchi, Kanagawa (JP); Arinobu Yoshiura, Kanagawa (JP); Takahiro Imada, Kanagawa (JP); Hajime Gotoh, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 320 days.

(21) Appl. No.: 13/293,561

(22) Filed: Nov. 10, 2011

(65) Prior Publication Data

US 2012/0121304 A1 May 17, 2012

(30) Foreign Application Priority Data

Nov. 12, 2010 (JP) ..... 2010-253984

(51) Int. Cl.
*G03G 15/20* (2006.01)

(52) U.S. Cl.
CPC .... *G03G 15/2039* (2013.01); *G03G 2215/2035* (2013.01)
USPC ..... 399/329

(58) Field of Classification Search
USPC ..... 399/122, 320, 328, 329; 219/216, 619
See application file for complete search history.

(56) References Cited

U.S. PATENT DOCUMENTS 7,957,663 B2 6/2011 Kishi et al.
8,428,499 B2 * 4/2013 Shinshi ..... 399/329

(Continued)

FOREIGN PATENT DOCUMENTS

CN 1215851 A 5/1999
CN 101183235 A 5/2008

(Continued)

OTHER PUBLICATIONS

U.S. Appl. No. 13/110,133, filed May 18, 2011, Hiroshi Yoshinaga.

(Continued)

*Primary Examiner* — Hoan Tran
(74) *Attorney, Agent, or Firm* — Oblon, Spivak, McClelland, Maier & Neustadt, L.L.P.

(57) ABSTRACT

A fixing device includes a rotatable, flexible fuser belt, a heater, a fuser pad, and a pressure member. The fuser belt is looped into a generally cylindrical configuration. The heater is disposed adjacent to the fuser belt to heat the fuser belt. The fuser pad is disposed inside the loop of the fuser belt, and has an outer peripheral surface thereof formed in a generally concave configuration. The pressure member is disposed opposite the fuser pad with the fuser belt interposed between the fuser pad and the pressure member. The pressure member presses in a load direction against the outer peripheral surface of the fuser pad through the fuser belt to form a fixing nip therebetween. The fuser pad includes, along the outer peripheral surface thereof, a protruding portion and an inwardly curved portion adjoining the protruding portion to face an outer circumferential surface of the pressure member.

33 Claims, 6 Drawing Sheets

(56) References Cited

U.S. PATENT DOCUMENTS

| | | | |
|---|---|---|---|
| 2004/0184849 | A1 | 9/2004 | Yonekawa |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0176822 | A1 | 7/2011 | Ishii et al. |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222888 | A1 | 9/2011 | Ikebuchi et al. |
| 2011/0222926 | A1 | 9/2011 | Ueno et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |

FOREIGN PATENT DOCUMENTS

| | | | |
|---|---|---|---|
| JP | 4-242774 | | 8/1992 |
| JP | 11-73046 | | 3/1999 |
| JP | 2003-215953 | | 7/2003 |
| JP | 2003-270981 | | 9/2003 |
| JP | 2004-29394 | * | 1/2004 |
| JP | 2004-70041 | | 3/2004 |
| JP | 2005-221533 | | 8/2005 |
| JP | 2006-242980 | | 9/2006 |
| JP | 2007-47674 | | 2/2007 |
| JP | 2008-151902 | | 7/2008 |
| JP | 2008-233886 | | 10/2008 |
| JP | 2009-3410 | | 1/2009 |
| JP | 2009-53507 | | 3/2009 |
| JP | 2010-26415 | | 2/2010 |
| JP | 2010-96782 | | 4/2010 |
| JP | 2010-224082 | | 10/2010 |
| JP | 2011-33671 | | 2/2011 |

OTHER PUBLICATIONS

U.S. Appl. No. 13/097,711, filed Apr. 29, 2011, Toshihiko Shimokawa, et al.

Chinese Office Action issued Nov. 29, 2013, in China Patent Application No. 201110345306.7.

Office Action mailed May 7, 2014, in Japanese Patent Application No. 2010-253984.

* cited by examiner

FIXING DEVICE AND IMAGE FORMING APPARATUS INCORPORATING SAME

CROSS-REFERENCE TO RELATED APPLICATIONS

This patent application claims priority pursuant to 35 U.S.C. §119 to Japanese Patent Application No. 2010-253984, filed on Nov. 12, 2010, the entire disclosure of which is hereby incorporated by reference herein.

BACKGROUND

1. Technical Field

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, which employs such a fixing device.

2. Description of the Background Art

In electrophotographic image forming apparatuses, such as photocopiers, facsimile machines, printers, plotters, or multifunctional machines incorporating several of those imaging functions, an image is formed by attracting developer or toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, the fuser member heats the recording medium to fuse and melt the toner particles, while the pressure member presses the recording medium against the fuser member to cause the molten toner to settle onto the recording medium.

One problem encountered when using such a fixing device is that a recording medium tends to curl or bend toward the fuser member, in a manner similar to that of a bimetallic strip, owing to expansion and contraction of its moisture content under heat through the fixing nip. Such curling causes the recording medium to eventually wind around the fuser member upon exiting the fixing nip, leading to malfunction or even failure of the fixing process.

To counteract the problem, there has been proposed a fixing device that includes a decurling member to prevent deformation of a recording medium passing downstream from a fixing nip along a media conveyance path.

According to this method, the decurling member comprises a protrusion disposed on a heater guide or frame that accommodates a heater having a flat, planar surface pressed against a pressure member through a fuser belt to establish a fixing nip therebetween. The protrusion is designed to contact the leading edge of a recording medium to direct it away from the fuser belt upon exiting the fixing nip, which allows the outgoing medium to proceed to a post-fixing unit along the media conveyance path without curling or deformation caused by the fixing process.

BRIEF SUMMARY

Exemplary aspects of the present invention are put forward in view of the above-described circumstances, and provide a novel fixing device.

In one exemplary embodiment, the fixing device includes a rotatable, flexible fuser belt, a heater, a fuser pad, and a pressure member. The fuser belt is looped into a generally cylindrical configuration. The heater is disposed adjacent to the fuser belt to heat the fuser belt. The fuser pad is disposed inside the loop of the fuser belt, and has an outer peripheral surface thereof formed in a generally concave configuration. The pressure member is disposed opposite the fuser pad with the fuser belt interposed between the fuser pad and the pressure member. The pressure member presses in a load direction against the outer peripheral surface of the fuser pad through the fuser belt to form a fixing nip therebetween, through which a recording medium travels in a conveyance direction under heat and pressure. The fuser pad includes, along the outer peripheral surface thereof, a protruding portion and an inwardly curved portion adjoining the protruding portion to face an outer circumferential surface of the pressure member. The protruding portion extends outside of and downstream from the fixing nip in the conveyance direction to protrude toward the pressure member while remaining out of contact with the outer circumferential surface of the pressure member. The inwardly curved portion extends over a downstream side of the fixing nip in the conveyance direction to conform to the outer circumferential surface of the pressure member.

Other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
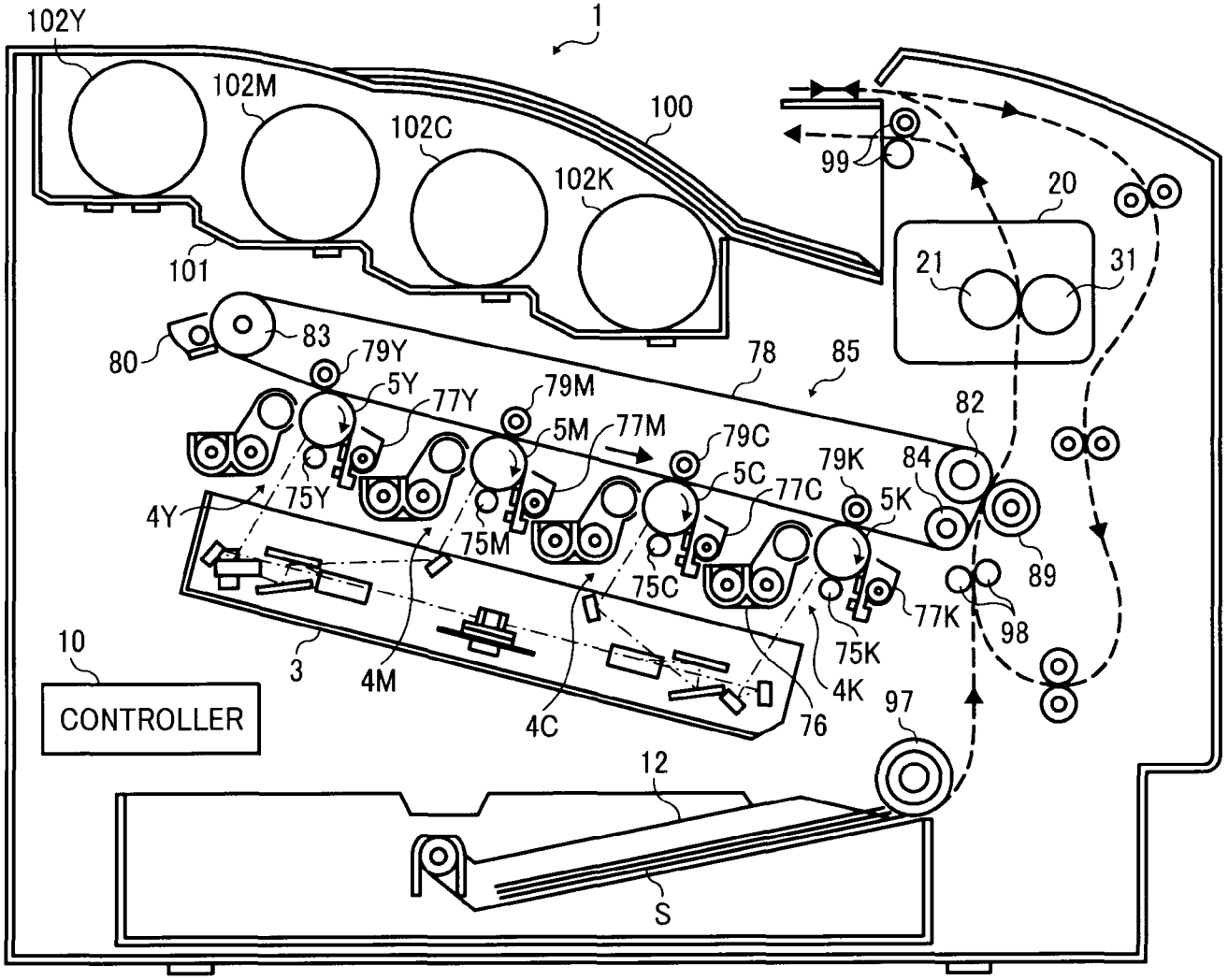
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a motor-driven, cylindrical photoconductor drum 5 surrounded by a charging device 75, a development device 76, a cleaning device 77, and a discharging device, which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from detachably attached, replaceable toner bottles 102Y, 102M, 102C, and 102K, respectively, accommodated in a toner supply 101 in the upper portion of the apparatus 1.

The intermediate transfer unit 85 includes an intermediate transfer belt 78, being an endless looped belt formed of a substrate of resin film or rubber. Also included in the intermediate transfer unit 85 are four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75, such as, for example, a contact charger held in contact with the photoconductive surface for charging the same. After charging, the photoconductive surface is exposed to a modulated laser beam emitted from the write scanner 3. The laser exposure selectively dissipates the charge on the photoconductive surface to form an electrostatic latent image thereon according to image data obtained by scanning an original document or transmitted from an external data source through a network. Then, the latent image is rendered visible through the development device 76, such as a non-contact development mechanism that supplies toner to the latent image without contacting the photoconductive surface. The toner image thus obtained is forwarded to the primary transfer nip between the primary transfer roller 79 and the photoconductor drum 5.

At the primary transfer nip, the primary transfer roller 79 is supplied with a bias voltage of a polarity opposite that of the toner on the photoconductor drum 5. This electrostatically transfers the toner image from the photoconductive surface to an outer surface of the intermediate transfer belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off for example, with a cleaning blade or brush, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

The image forming apparatus 1 described above may be configured as any type of electrophotographic imaging system, such as a photocopier, facsimile machine, printer, plotter, or multifunctional machine incorporating several of those imaging functions, and may have additional or modified components required to perform such imaging functions. For example, where the image forming apparatus 1 includes a facsimile capability, a dedicated, facsimile output tray may be provided for stacking recording media on which a telecommunicated image is printed according to a facsimile signal sent via a telephone line.

Operation of the image forming apparatus 1 is governed by a central controller or microcomputer 10 including a central processing unit (CPU) combined with a read-only memory (ROM) that stores programs for execution by the CPU, as well as other volatile or non-volatile data storage, such as a random-access memory (RAM) and input/output interface software.

The central controller 10 is connected with various actuator devices involved in the electrophotographic processes, such as rotary motors or actuators driving the photoconductive drums 5 of the imaging unit 4 and the pressure roller 31 of the fixing unit 20, and a power supply for a heater included in the thermal fixing process, as well as various sensors that detect, for example, changes in operational conditions to output detection signals, based on which the controller 10 controls operation of the actuator devices. An operation panel including various input/output devices, such as keys, buttons, and display monitors, is provided in the image forming apparatus 1 to allow the controller 10 to convey information to and from a human operator manipulating the operation panel.

Figure 2:
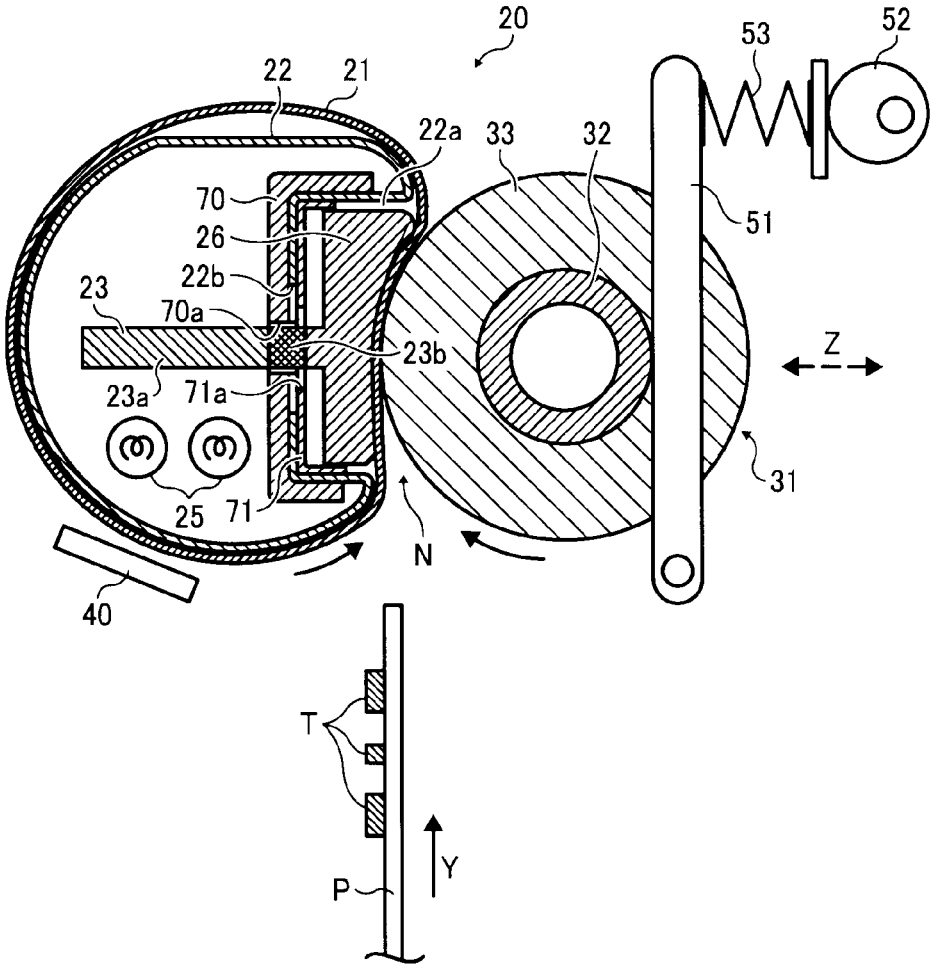
FIG. 2 is an end-on, axial cutaway view of the fixing device incorporated in the image forming apparatus of FIG. 1.

FIG. 2 is an end-on, axial cutaway view of the fixing device 20 incorporated in the image forming apparatus 1 according to one embodiment of this patent specification.

As shown in FIG. 2, the fixing device 20 includes a rotatable, flexible fuser belt 21 looped into a generally cylindrical configuration; a fuser pad 26 disposed inside the loop of the fuser belt 21, and having an outer peripheral surface thereof formed in a generally concave configuration; and a pressure member 31 disposed opposite the fuser pad 26 with the fuser belt 21 interposed between the fuser pad 26 and the pressure member 31. The pressure member 31 presses in a load direction Z against the outer peripheral surface of the fuser pad 26 through the fuser belt 21 to form a fixing nip N therebetween, through which a recording sheet S travels in a conveyance direction Y under heat and pressure.

Also included in the fixing device 20 are a generally cylindrical, tubular heat pipe 22 around which the fuser belt 21 is entrained; one or more radiant heaters 25 disposed adjacent to the fuser belt 21 to heat the fuser belt 21; a reinforcing member 23 disposed in contact with the fuser pad 26 inside the loop of the fuser belt 21 to restrict displacement of the fuser pad 26 at least in the load direction Z. A pair of inner and outer, retaining stays 70 and 71 may be provided to retain the heat pipe 22 in shape. A thermometer 40, such as a thermistor, may be disposed adjacent to the fuser belt 21 to detect a temperature at an outer surface of the fuser belt 21.

Figure 3:
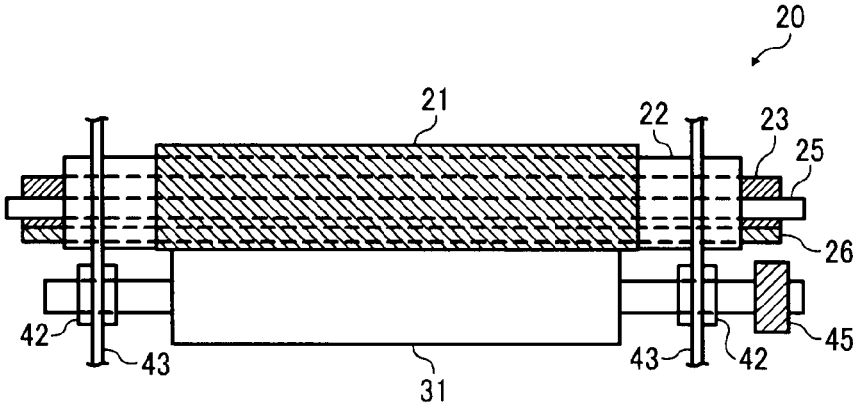
FIG. 3 is a top plan view of the fixing device of FIG. 2.

With additional reference to FIG. 3, which is a top plan view of the fixing device 20, the pressure roller 31 and the fuser belt 21 are shown extending in an axial, longitudinal direction perpendicular to the conveyance direction Y and the load direction Z between a pair of sidewalls 43. Components disposed inside the loop of the fuser belt 21, including the heat pipe 22, the reinforcing member 23, the heater 25, and the fuser pad 26, also extend in the axial direction with their respective longitudinal ends secured to the sidewalls 43 which hold the elongated components stationary in position in the fixing device 20.

During operation, a rotary drive motor activates the pressure roller 31 to rotate clockwise in the drawing, which in turn rotates the fuser belt 21 counterclockwise in the drawing around the heat pipe 22. The pressure roller 31 is biased in the load direction Z against the fuser pad 26 through the fuser belt 21 to establish a fixing nip N therebetween.

Meanwhile, the power source starts supplying electricity to the heater 22, which then generates heat for conduction to the heat pipe 22 to in turn heat the fuser belt 21 rotating therearound. Power supply to the heater 22 is adjusted by the central controller 10 according to readings of the thermometer 40 detecting the surface temperature of the fuser belt 21, so as to heat the fixing nip N to a given processing temperature sufficient for processing toner particles in use.

Then, a recording sheet S bearing an unfixed, powder toner image T enters the fixing device 20 with its front, printed face brought into contact with the fuser belt 21 and bottom face into contact with the pressure roller 31. As the fuser belt 21 and the pressure roller 31 rotate together, the recording sheet S moves in the conveyance direction Y through the fixing nip N, where the fuser belt 21 heats the incoming sheet S to fuse and melt the toner particles, while the pressure roller 31 presses the sheet S against the fuser pad 26 to cause the molten toner to settle onto the sheet surface.

In the present embodiment, the fuser belt 21 comprises a thin, flexible endless belt consisting of a thermally conductive substrate upon which an intermediate layer of elastic material and an outer layer of release agent are deposited one upon another to form a multilayered structure, approximately 1 mm or smaller in thickness. The multilayered belt 21 is looped into a generally cylindrical configuration, approximately 15 mm to approximately 120 mm in diameter, so that the outer layer faces the exterior of the loop and the substrate faces the interior of the loop. For example, the fuser belt 21 may be a multilayered endless belt having an outer diameter of approximately 30 mm in its looped, generally cylindrical configuration before assembly with the heat pipe 22.

The substrate of the belt 21 may be formed of thermally conductive material, approximately 20 μm to approximately 35 μm thick, including nickel, stainless, or any suitable metal, as well as synthetic resin such as polyimide (PI). The elastic layer of the belt 21 may be a deposit of rubber, such as solid or foamed silicone rubber, fluorine resin, or the like, approximately 100 μm to approximately 300 μm thick on the substrate 21*a*. The outer coating may be a deposit of a release agent, such as tetra fluoro ethylene-perfluoro alkylvinyl ether copolymer or PFA, polytetrafluoroethylene (PTFE), polyimide (PI), polyetherimide (PEI), polyethersulfide (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. The release coating layer provides good stripping of toner from the belt surface to ensure reliable conveyance of recording sheets S through the fixing nip N.

The heater 25 comprises an elongated, radiant heating element, such as a halogen heater or a carbon heater, extending inside the tubular heat pipe 22 to radiate heat to an inner circumferential surface of the heat pipe 22, so as to in turn heat the fuser belt 21 through conduction from the heat pipe 22. The inner circumferential surface of the heat pipe 22 may be coated with a black, thermally absorptive material to increase emissivity of the heat pipe 22 for obtaining high thermal efficiency in heating the fuser belt 21 with the radiant heater 25.

The heat pipe 22 comprises a longitudinally slotted tubular body having a generally circular, C-shaped cross-section, with a longitudinal side slot 22*a* in one side thereof for accommodating the fuser pad 26 therein. An opening or slit 22*b* is defined in an interior, central wall forming the side slot 22*a* to allow the reinforcing member 23 to extend outward to contact the fuser pad 26 within the side slot 22*a*. A pair of mounting flanges formed of suitable material, such as resin, may be provided to the longitudinal ends of the heat pipe 22 to secure the pipe 22 in position onto the sidewalls 43 of the fixing device 20.

The heat pipe 22 has its conductive body directly heated by radiation from the radiant heater 25, which, in turn, indirectly heats the fuser belt 21 rotating around the cylindrical body. The longitudinally slotted configuration of the heat pipe 22 allows for efficient heating of the fuser belt 21 over an extended circumferential area where the fuser belt 21 contacts the heat pipe 22 subjected to heating outside the fixing nip N, in particular, upstream from the fixing nip N.

More specifically, the heat pipe 22 comprises a generally cylindrical, thin-walled pipe approximately 0.1 mm to approximately 1 mm thick, formed of thermally conductive metal, such as aluminum, iron, stainless, or the like. Designing the heat pipe 22 with a wall thickness of 0.2 mm or less is preferable in terms of thermal efficiency, since such an extremely thin-walled pipe is effectively heated to allow for immediate heating of the fuser belt 21 through conduction. In the present embodiment, the heat pipe 22 is a pipe formed of stainless steel approximately 0.1 mm thick.

Although the heat pipe 22 depicted in FIG. 2 is configured as a generally cylindrical body having a substantially circular cross-section, configuration of the heat pipe 22 may be other than that depicted in the present embodiment, including, for example, a hollow prismatic body having a complex, polygonal cross-section.

The heat pipe 22 has its outer diameter dimensioned relative to the inner diameter the fuser belt 21, so that the fuser belt 21 during rotation adjoins a heated circumferential portion (i.e., upstream from the fixing nip N in the present embodiment) of the heat pipe 22, at which the heat pipe 22 is internally subjected to radiation from the heater 25, uninterrupted by the reinforcing member 23 inside the heat pipe 22.

For example, the fuser belt 21 may be in close proximity with the heated circumferential portion of the heat pipe 22, with a gap of approximately 0.3 mm or less left between the adjoining surfaces of the belt 21 and the pipe 22. Alternatively, instead, the fuser belt 21 may establish a direct, sliding contact with the heated circumferential portion of the heat pipe 22 for obtaining higher thermal efficiency in heating the fuser belt 21. In such cases, to prevent premature abrasion or damage due to increased torque on the sliding surfaces of the belt 21 and the pipe 22, the fuser belt 21 and the heat pipe 22 is designed to contact each other with a contact pressure of approximately 0.3 kgf/cm$^2$ or smaller.

Additionally, to protect the fuser belt 21 against abrasion from contact with the heat pipe 22, a lubricating agent, such as fluorine grease, may be deposited on the outer circumferential surface of the heat pipe 22. Reducing friction between the fuse belt 21 and the heat pipe 22 may also be accomplished by forming the sliding surface of the heat pipe 22 with a material of low frictional coefficient, or providing a coating layer containing fluorine on the inner circumferential surface of the fuser belt 21.

Provision of the heat pipe 22 allows for a reliable fast fixing process with a short warm-up time and fast-print time required to execute a print job, while effectively preventing imaging defects caused due to insufficient heating of the fuser belt even where the fixing device operates at a higher processing speed. Such a heating assembly does not require a complicated structure, leading to a compact configuration of the belt-based fixing device 20.

The reinforcing member 23 comprises an elongated, substantially rectangular piece of rigid metal, such as stainless or steel, dimensioned to be accommodated inside the tubular body of the heat pipe 22, having a length substantially equal to that of the fuser pad 26. The reinforcing member 23 may be secured to the sidewalls 43 of the fixing device 20 through the mounting flange of the heat pipe 22.

Figure 4:
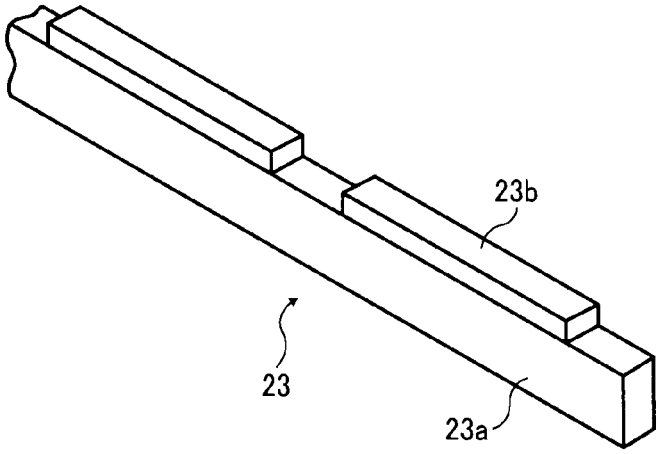
FIG. 4 is a perspective view of a reinforcing member before assembly into the fixing device of FIG. 2.

With additional reference to FIG. 4, which is a perspective view of the reinforcing member 23 before assembly, the reinforcing member 23 is shown consisting of a rigid, elongated beam 23*a*, and multiple contact portions or protrusions 23*b* disposed along the length of the beam 23*a* on a side that faces the fuser pad 26 upon assembly.

The reinforcing member 23 supports pressure from the pressure roller 31 through the fuser pad 26 and the fuser belt 21 in the load direction Z, so as to prevent the fuser pad 26 from significant deformation under pressure at the fixing nip N during operation. Providing the reinforcing member 23 with the multiple contact portions 23*b* allows the fuser pad 26 to equalize nip pressure in the longitudinal direction, leading to good fixing performance with uniform nip pressure across the fixing nip N.

Optionally, the reinforcing member 23 may be at least partially provided with a covering of thermal insulator, or subjected to a bright annealing or mirror polish, where it faces the heater assembly 25 inside the heat pipe 22. Such arrangement prevents heat from dissipation in the reinforcing member 23, and thus causes more heat to accumulate in the heat pipe 22, leading to higher thermal efficiency in heating the fuser belt 21 around the internally heated pipe 22.

The pair of inner and outer, retaining stays 70 and 71 is disposed around the side slot 22*a* of the heat pipe 22, the former fitted along the inner surfaces of the heat pipe 22 and the latter along the outer surfaces of the heat pipe 22. The fuser pad 26 is disposed inside the outer retaining stay 71 with a clearance left between the adjoining surfaces of the fuser pad 26 and the retaining stay 71.

Figure 5:
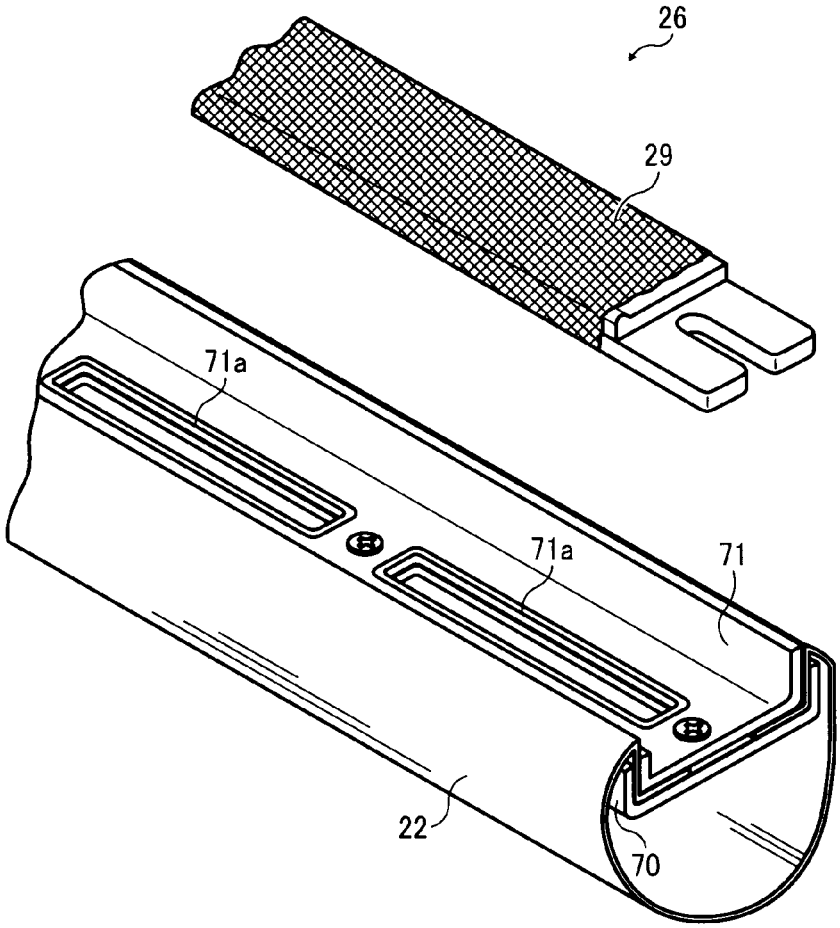
FIG. 5 is a perspective view of a heat pipe and a fuser pad during assembly into the fixing device of FIG. 2.

With additional reference to FIG. 5, which is a perspective view of the heat pipe 22 and the fuser pad 26 during assembly, the retaining stays 70 and 71 are shown each comprising an elongated, semi-tubular piece of sheet metal having a rectangular U-shaped cross-section. For example, the retaining stay may be formed by bending a sheet of stainless steel, approximately 1.5 mm thick, into a semi-tubular rectangular configuration.

The inner retaining stay 70 has one or more through-holes 70*a* defined where it faces the slitted wall of the side slot 22*a* from inside, whereas the outer retaining stay 71 has one or more through-holes 71*a* defined where it faces the slitted wall of the side slot 22*a* from outside. The number of the through-holes in each retaining stay is equal to that of the contact portions 23*b* of the reinforcing member 23 (e.g., five in the present embodiment), and the size of the through-holes in each retaining stay is larger than that of the contact portions 23*b*. The through-holes 70*a* and 71*a* are aligned with the slit 22*b* of the side slot 22*a* to allow the contact portions 23*b* of the reinforcing member 23 to extend outward to contact the fuser pad 26 inside the side slot 22*a*.

To obtain the heat pipe assembly described above, the heat pipe 22 is produced by forming a sheet of metal, such as a 0.1-mm sheet of stainless steel, into a rolled configuration, followed by bending two longitudinal edges of the rolled sheet inward to form opposed walls of the side slot 22*a* each with a substantially L-shaped cross-section. With the slotted heat pipe 22 thus prepared, the inner retaining stay 70 is fitted along the inner surfaces of the heat pipe 22, and the outer retaining stay 71 is fitted along the outer surfaces of the heat pipe 22, thereby clamping together the opposed walls of the side slot 22*a* therebetween to retain the heat pipe 22 in its generally cylindrical configuration.

Provision of the retaining stays allows for high precision and stability in the shape of the side slot 22*a* of the heat pipe 22, which in turn allows the fuser pad 26 to reliably hold its outer surface substantially parallel to the surface of the recording sheet S advanced in the conveyance direction Y, so that the fuser belt 21 can establish close contact with the recording sheet S along the fixing nip N, leading to reliable imaging performance of the fixing device 20.

The inner retaining stay 71 may be subjected to bright annealing or mirror polish where it faces the heater assembly 25 inside the heat pipe 22, which allows for more efficient heating with the fuser pipe 22. Also, the outer retaining stay 72 may be formed into a box-like, closed-end configuration, instead of a semi-tubular rectangular configuration, in which case the retaining stay 72 can effectively restricts displacement of the fuser pad 26 in the directions perpendicular to the conveyance direction Y.

With continued reference to FIGS. 2 and 3, the pressure roller 31 is shown comprising a motor-driven, elastically biased cylindrical body formed of a hollowed core 32 of metal, covered with an elastic layer 33 of thermally insulating material, such as sponged or solid silicone rubber, fluorine rubber, or the like. An additional, thin outer layer of release agent, such as PFA, PTFE, or the like, may be deposited upon the elastic layer 33. In the present embodiment, the pressure roller 31 is approximately 30 mm in diameter.

The pressure roller 31 is equipped with a biasing mechanism, formed of a lever 51 connected to a cam 52 through a spring 53, which elastically presses the cylindrical body against the fuser belt assembly. A gear 45 is provided to a shaft of the pressure roller 31 for connection to a gear train of a driving mechanism that imparts a rotational force or torque to rotate the cylindrical body under control of the central controller 10. A pair of bearings 42 is provided to the longitudinal ends of the pressure roller 31 to rotatably hold the roller 31 in position onto the sidewalls 43 of the fixing device 20. Optionally, the pressure roller 31 may have a dedicated heater, such as a halogen heater, accommodated in the hollow interior of the metal core 32.

The elastic layer 33 of the pressure roller 31 may be formed of a sponged material, such as sponged silicone rubber. Such an elastic layer 33 effectively absorbs extra pressure applied to the fuser pad 26 from the pressure roller 31, which protects the fuser pad 26 against deformation under nip pressure. The elastic layer 33 of sponged material also serves as an insulator that prevents heat conduction from the fuser belt 21 toward the pressure roller 31, leading to high thermal efficiency in heating the fuser belt 21 in the fixing device 20.

The fuser pad 26 comprises an elongated, substantially rectangular piece of heat-resistant resin material, such as liquid crystal polymer (LCP), PI, polyamide-imide (PAI), dimensioned to engage the outer retaining stay 71 within the side slot 22*a*, extending parallel to the reinforcing member 23 in the axial direction of the heat pipe 22.

Figure 6:
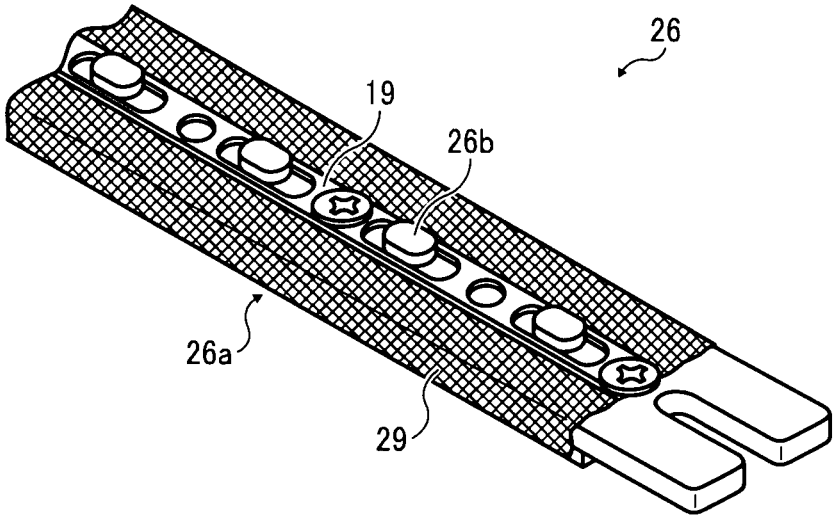
FIG. 6 is a perspective view of the fuser pad with its front side down and rear side up before assembly.

With additional reference to FIG. 6, which is a perspective view of the fuser pad 26 with its front side down and rear side up before assembly, the fuser pad 26 is shown including an elongated body 26*a* that defines a generally concave, outer peripheral surface on the front side of the fuser pad 26 to face the pressure roller 31, and multiple contact portions or protrusions 26*b* arranged in series along the length of the elongated body 26*a* on the rear side of the fuser pad 26. A covering 29 of anti-friction material, such as a web or mesh of PTFE fibers or fluorine-coated glass fibers, is wound around the elongated body 26*a* for reducing friction between the fuser pad 26 and the fuser belt 21, with a perforated attachment 19 fitted around the protrusions 26*b* and screwed onto the elongated body 26*a* to secure the covering 29 in position.

The fuser pad 26 is inserted into the side slot 22*a* of the heat pipe 22 with the front, smooth surface of the elongated body 26*a* facing outward and the multiple protrusions 26*b* facing inward of the tubular heat pipe 22, so that the smooth surface of the body 26*a* slidably contacts the pressure roller 31 via the fuser belt 21 and the protrusions 26*b* contact the reinforcing member 23 through the openings 69, 70*a*, and 71*a* aligned with each other. The fuser pad 26 is secured in position on the heat pipe 22 via the mounting flanges 28.

In such a configuration, the fuser pad 26 can support nip pressure from the pressure roller 31 without significant deformation and displacement during operation, where the elongated body 26*a* slightly bends under pressure applied in the load direction Z to cause the protrusions 26*b* to contact the reinforcing member 23 to relieve nip pressure therethrough.

The multiple protrusions 26*b* may be either of identical dimensions with respect to each other, or provided with varying depths in the load direction Z depending on their position along the length of the fuser pad 26, so that the one at the longitudinal center is the deepest and those at the longitudinal ends are the shallowest of all the protrusions 26*b*. Dimensioning the protrusions 26*b* with varying depths allows the fuser pad 26 to more effectively equalize nip pressure in the longitudinal direction, leading to good fixing performance with uniform nip pressure across the fixing nip N.

Figure 7:
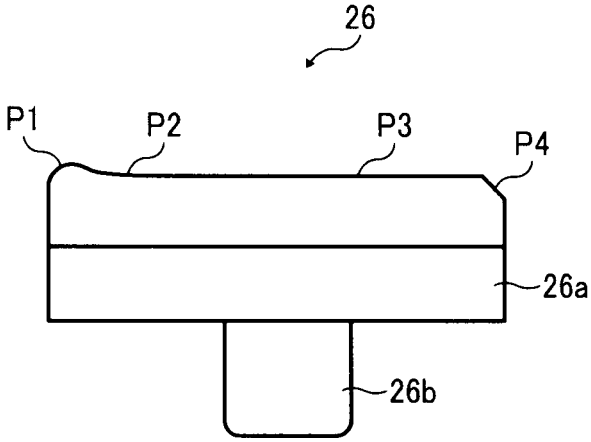
FIG. 7 is a cross-sectional view of the fuser pad included in the fixing device of FIG. 2.

FIG. 7 is a cross-sectional view of the fuser pad 26 included in the fixing device 20.

As shown in FIG. 7, the fuser pad 26 includes, along the generally concave, outer peripheral surface thereof, a first, protruding portion P1, a second, inwardly curved portion P2 adjoining the first portion P1, and a third, planar portion P3 adjoining the second portion P2 away from the first portion P1, with a distal end of the third portion P3 shaped into a chamfered or beveled edge P4 angled with respect to the plane of the third portion P3. Each of the peripheral portions P1 through P4 extends in the axial, longitudinal direction of the elongated body 26*b* of the fuser pad 26, so as to encompass at least a maximum width of recording medium S accommodated through the fixing nip N upon assembly into the fixing device 20.

Figure 8:
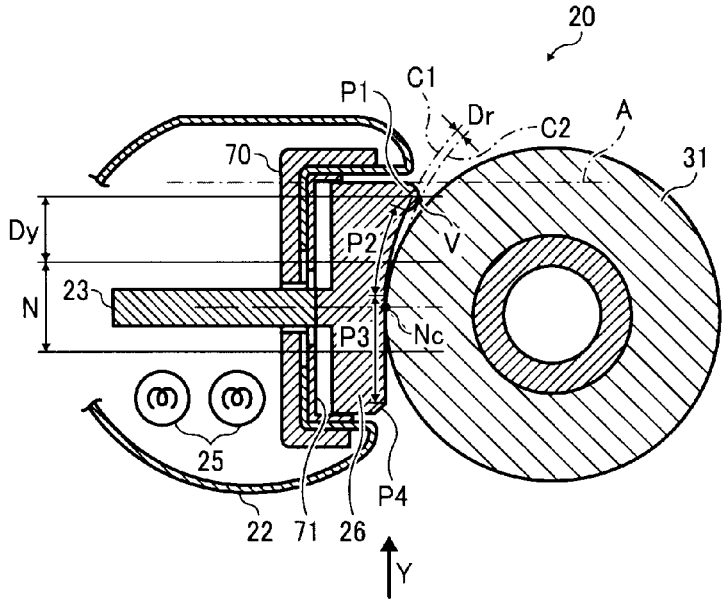
FIG. 8 is an end-on, axial view of the fuser pad assembled into the fixing device.

FIG. 8 is an end-on, axial view of the fuser pad 26 assembled into the fixing device 20, shown with the fuser belt 21 omitted for brevity.

As shown in FIG. 8, in the assembled fixing device 20, the fuser pad 26 is positioned with the first, second, third, and fourth peripheral portions P1, P2, P3 and P4 arranged in series in the recited order from downstream to upstream in the conveyance direction Y to face an outer circumferential surface of the pressure roller 31.

The first, protruding portion P1 extends outside of and downstream from the fixing nip N in the conveyance direction Y to protrude toward the pressure roller 31 while remaining out of contact with the outer circumferential surface of the pressure roller 31. The second, inwardly curved portion P2 extends over a downstream side of the fixing nip N in the conveyance direction Y, with its upstream end meeting the downstream end of the third portion P3 and its downstream end meeting the upstream end of the first portion P1, to conform to the outer circumferential surface of the pressure roller 31.

As used herein, the term "conveyance direction" refers to a direction in which a recording medium or sheet S is conveyed through the fixing nip N, as indicated by arrow Y in the drawings. Also, the terms "upstream" and "downstream", when used in connection with the peripheral portions of the fuser pad 26, refer to positions relative to the fixing nip N in the conveyance direction Y as set forth herein, so that the recording medium S, during conveyance from upstream to downstream through the fixing nip N, first meets the chamfered edge P4, then the planar portion P3, then the inwardly curved portion P2, and finally the protruding portion P1 along the generally concave, peripheral surface of the fuser pad 26.

Specifically, in the present embodiment, the protruding portion P1, in cross section, defines an outward curve whose vertex V touches an imaginary curve C2 concentric to, and smaller in radius than, an imaginary curve C1 with which the inwardly curved portion P2 coincides. A distance Dr, in a radial direction of the inwardly curved portion P2, between the downstream end of the fixing nip N and the vertex V of the protruding portion P1 (i.e., a difference in radius between the concentric curves C1 and C2) falls within a range between approximately 0.1 mm to approximately 0.2 mm. Also, a distance Dy, in the conveyance direction Y of the recording sheet S, between the downstream end of the fixing nip N and the vertex V of the protruding portion P1 falls within a range between approximately 1 mm to approximately 2 mm.

More specifically, the outward curve of the protruding portion P1 comprises an arc of a circle with a specific radius of curvature, so as to simultaneously meet the imaginary curve C2 and an imaginary plane A defined by, or containing, a downstream side wall of the fuser pad 26 perpendicular to the conveyance direction Y. Such arrangement prevents the recording sheet S from excessively bending around the protruding portion P1, so as to allow for ready separation of the recording sheet S from the fuser belt 21 upon exiting the fixing nip N.

Figure 9:
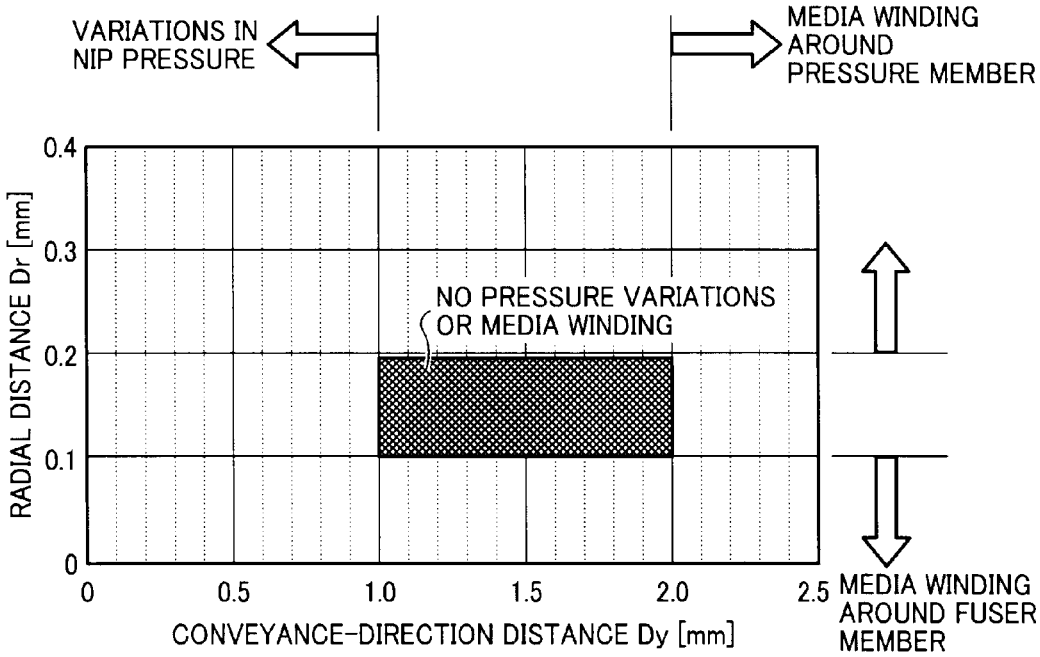
FIG. 9 is a schematic diagram illustrating different ranges of the radial and conveyance-direction distances, shown with problems associated with specific distance ranges in the fixing device.

FIG. 9 is a schematic diagram illustrating different ranges of the radial and conveyance-direction distances Dr and Dy, shown with problems associated with specific distance ranges with which the outward curve of the protruding portion P1 may be dimensioned.

As shown in FIG. 9, setting the conveyance-direction distance Dy below 1 mm can cause variations in pressure across the fixing nip N, in which interference between the protruding portion P1 and the pressure roller 31 causes the adjoining peripheral portion P2 of the fuser pad 26 to partly come off the outer circumferential surface of the pressure roller 31, resulting in a locally reduced area of contact between the fuser pad 26 and the pressure roller 31 within the fixing nip N. Such variations in contact between the fixing members can translate into variations in pressure with which a toner image is processed through the fixing nip N, leading to concomitant print defects, such as orange-peel effects, in the resulting image.

Further, setting the conveyance-direction distance Dy above 2 mm and/or setting the radial distance Dr above 0.2 mm can cause the recording sheet S to wind around the pressure roller 31, in which interference between the protruding portion P1 and the recording sheet S causes the sheet S to bend and deflect away from the fuser pad 26 to eventually wrap around the outer circumferential surface of the pressure roller 31 upon exiting the fixing nip N. This is particularly true during duplex printing, in which the recording sheet S enters the fixing nip N with a first, previously printed side facing the pressure roller 31 and a second, unfixed side facing the fuser belt 21, which causes toner once fixed on the first side to soften and become adhesive to the pressure roller 31 due to heat within the fixing nip N.

Moreover, setting the radial distance Dr below 0.1 mm increases the risk of winding the recording sheet S around the fuser belt 21, in which the protruding portion P1 fails to properly separate the recording sheet S from the fuser belt 21, causing the outgoing sheet S to eventually wrap around the circumferential surface of the belt 21 at the exit of the fixing nip N.

Thus, setting the radial distance Dr between approximately 0.1 mm to approximately 0.2 mm and the conveyance-direction distance Dy between approximately 1 mm to approximately 2 mm, as in the present embodiment, is effective to obtain a fixing process without causing variations in nip pressure or winding of recording medium around the fixing members.

Referring back to FIG. 8, the inwardly curved portion P2, in cross section, defines an inward curve or arc that has a radius of curvature ranging from approximately 25 mm to approximately 60 mm, so as to effectively conform to the outer circumferential surface of the pressure roller 31 that has a particular diameter. For example, the radius of curvature of the inwardly curved portion P2 is approximately 60 mm where the diameter of the pressure roller 31 is approximately 30 mm. Such arrangement prevents the fuser belt 21 from excessively bending around the protruding portion P1 downstream from the fixing nip N, which would otherwise result in damage and premature failure of the fuser belt assembly.

The upstream end of the second portion P2, coextensive with the downstream end of the third portion P3, may be any point within the fixing nip N, which is determined with respect to a center Nc of the fixing nip N in the conveyance direction Y. In the present embodiment, the upstream end of the second portion P2 is located downstream from the center Nc of the fixing nip N, in which case the third portion P3 encompasses a broader area within the fixing nip N than that of the second portion P2. Positioning of the upstream and downstream ends of the adjoining peripheral portions P2 and P3 of the fuser pad 26 may be other than that described in FIG. 8, such as upstream from, or coincident with the center Nc of the fixing nip N, depending on the specific configuration.

The planar portion P3 extends over an upstream side, opposite the downstream side, of the fixing nip N along which a recording sheet S after passing through the secondary transfer nip defined between the backup roller 82 and the secondary transfer roller 89 enters the fixing nip N in the conveyance direction Y.

Provision of the upstream planar portion P3 allows for reliable conveyance of recording sheet S through the fixing nip N, wherein the recording sheet S, conveyed along the planar surface of the fuser pad 26, can maintain its generally flat, planar configuration without bending upon entry into the fixing nip N from the secondary transfer nip.

The chamfered edge P4 is located immediately upstream from the fixing nip N, where the inner circumferential surface of the fuser belt 21 separates from an upstream, longitudinal edge of the side slot 22*a* of the heat pipe 22 and subsequently comes into sliding contact with the fuser pad 26. In the present embodiment, the chamfered edge P4 comprises an inclined surface that extends, for example, approximately 0.5 mm at an angle of 45 degrees with respect to the plane of the third portion P3.

For comparison purposes, assume that the fuser pad 26 has a perpendicular edge, instead of a chamfered edge, opposite the edge of the side slot 22*a* of the heat pipe 22. In such cases, presence of the perpendicular edge creates a gap or unevenness between the adjoining surfaces of the heat pipe 22 and the fuser pad 26, which cause the fuser belt 21 to bend and elevate away from contact with the heat pipe 22 immediately upstream from the fixing nip N, resulting in damage and premature failure of the belt material as well as insufficient heating of the fuser belt 21 before entering the fixing nip N.

By contrast, the chamfered edge P4 of the fuser pad 26, together with the adjoining edge of the heat pipe 22, form a substantially continuous surface along which the fuser belt 21 smoothly passes from the heat pipe 22 to the fuser pad 26. Such arrangement prevents the fuser belt 21 from damage and premature failure due to bending upon contacting the fuser pad 26, while allowing the heat pipe 22 to reliably contact and slide against the fuser belt 21 to heat the belt 21 sufficiently immediately upstream from the fixing nip N, leading to high thermal efficiency in heating the fuser belt 21.

Hence, the fixing device 20 according to this patent specification can process a recording sheet S with good imaging quality and conveyance performance, wherein combination of the protruding portion P1 and the inwardly curved portion P2 along the peripheral surface of the fuser pad 26 maintains a reduced gap between the fuser belt 21 and the recording sheet S travelling not only within the fixing nip N, but also outside of and downstream from the fixing nip N in the conveyance direction Y, compared to a configuration in which the fuser pad defines a flat, planar surface over a downstream side of the fixing nip N. Reducing the gap between the fuser belt 21 and the recording sheet S allows the fixing device 20 to apply sufficient heat and pressure to the recording sheet S within the fixing nip N, thereby preventing imaging defects that would arise from insufficient heating and pressure during fixing process.

In particular, provision of the protruding portion P1 outside of and downstream from the fixing nip N allows for ready separation of the recording sheet S from the fuser belt 21 at the exit of the fixing nip N. Positioning the protruding portion P1 out of contact with outer circumferential surface of the pressure roller 31 prevents undue interference of the protruding portion P1 with the pressure roller 31 and the recording sheet S, which would otherwise result in imaging defects due to variations in width and strength of the fixing nip N, and other failures of the fixing process due to the recording sheet S winding around the pressure roller 31.

Also, combining the protruding portion P1 with the inwardly curved portion P2 prevents the fuser belt 21 from excessively bending around the protruding portion P1 during rotation, as it maintains the vertex of the protruding portion P1 at a desired, operational position or angle relative to the downstream end of the fixing nip N, even where there is an elongated area of contact between the fuser belt 21 and the pressure roller 31 due to dimensional variations in the pressure roller 31, such as those resulting from thermal expansion and/or process tolerances, changing the position of the fixing nip N in the conveyance direction Y.

Further, provision of the planar portion P3 which extends over the upstream side, opposite the downstream side, of the fixing nip N in the conveyance direction Y along the peripheral surface of the fuser pad 26 enables the fixing device 20 to reliably convey the recording sheet S through the fixing nip N.

Still further, locating the upstream end of the inwardly curved portion P2 downstream from the center Nc of the fixing nip N in the conveyance direction Y enables the fixing device 20 to readily introduce the recording sheet S to the upstream side of the fixing nip N, allowing for reliable conveyance performance and compact configuration of the fixing device 20.

Yet still further, shaping the protruding portion P1 with a circular, arc-shaped cross section with a specific radius of curvature prevents excessive bending of the recording sheet S around the protruding portion P1, leading to reliable separation of the recording sheet S from the fuser belt 21 at the exit of the fixing nip N.

Yet still further, shaping the inwardly curved portion P2 with an inwardly curved cross section with a radius of curvature ranging from approximately 25 mm to approximately 60 mm allows the second portion P2 to effectively conform to the outer circumferential surface of the pressure roller 31, thereby preventing the fuser belt 21 from excessively bending around the protruding portion P1 downstream from the fixing nip N, which would otherwise result in damage and premature failure of the fuser belt assembly.

Yet still further, setting the radial distance Dr, in a radial direction of the inwardly curved portion P2, between the downstream end of the fixing nip N and the vertex of the protruding portion P1 between approximately 0.1 mm to approximately 0.2 mm effectively prevents the recording sheet S from winding around the fuser belt 21 and the pressure roller 31.

Yet still further, setting the distance Dy, in the conveyance direction Y of the recording sheet S, between the downstream end of the fixing nip N and the vertex of the protruding portion P1 between approximately 1 mm to approximately 2 mm effectively prevents the recording sheet S from winding around the fuser belt 21 and the pressure roller 31.

Yet still further, forming the fuser belt 21 with a substrate of thermally conductive material, such as stainless steel, nickel, and polyimide, approximately 20 μm to approximately 35 μm in thickness, as mentioned earlier, effectively protects the fuser belt 21 against bending fatigue upon sliding contact with the protruding portion P1 of the fuser pad 26, which allows for increased durability of the fuser belt assembly.

Yet still further, provision of the generally cylindrical body of metal, or heat pipe 22 around which the fuser belt 21 is entrained causes the fuser belt 21 to rotate in its generally cylindrical configuration while heated by conduction from the heat pipe except at the fixing nip N, as mentioned earlier, leading to efficient heating of the fuser belt 21 in the fixing device 20. In such cases, using the heater 25 disposed inside the heat pipe 22 allows for efficient, immediate heating of the fuser belt 21, in which the heated pipe 22 in turn heats the belt 21 through conduction, while retaining the rotating belt 21 in shape therearound.

Furthermore, provision of the reinforcing member 23 disposed in contact with the fuser pad 26 inside the loop of the fuser belt 21 to restrict displacement of the fuser pad at least in the load direction Z enables the fixing device 20 to apply a desired, stable pressure to the recording sheet S across the fixing nip N.

In further embodiment, the fixing device 20 may be provided with an additional inwardly curved portion having a radius of curvature different from that of the inwardly curved portion P2 and adjoining the inwardly curved portion P2 along the outer concave surface of the fuser pad 26, in place of the planar portion P3, which extends over an upstream side, opposite the downstream side, of the fixing nip N in the conveyance direction Y.

In such cases, the radius of curvature of the additional inwardly curved portion is greater than that of the inwardly curved portion P2, so as to allow for reliable conveyance of recording sheet S as is the case with the planar portion P3 upstream from the inwardly curved portion P2. Further, the fuser pad 26 may also include a planar portion adjoining the additional inwardly curved portion and away from the inwardly curved portion P2 along the outer surface of the fuser pad 26, which extends upstream from the upstream side, opposite the downstream side, of the fixing nip N in the conveyance direction Y.

Although in several embodiments depicted above primarily with reference to FIG. 2, the fixing device 20 is shown including specific types of the heater and heat pipe for heating the fuser belt assembly, configuration of the heating equipment employed in the fixing device 20 may be other than those depicted in FIG. 2. Embodiments with different alternative configurations of the fixing device 20 are described hereinbelow with reference to FIG. 10 and subsequent drawings.

Figure 10:
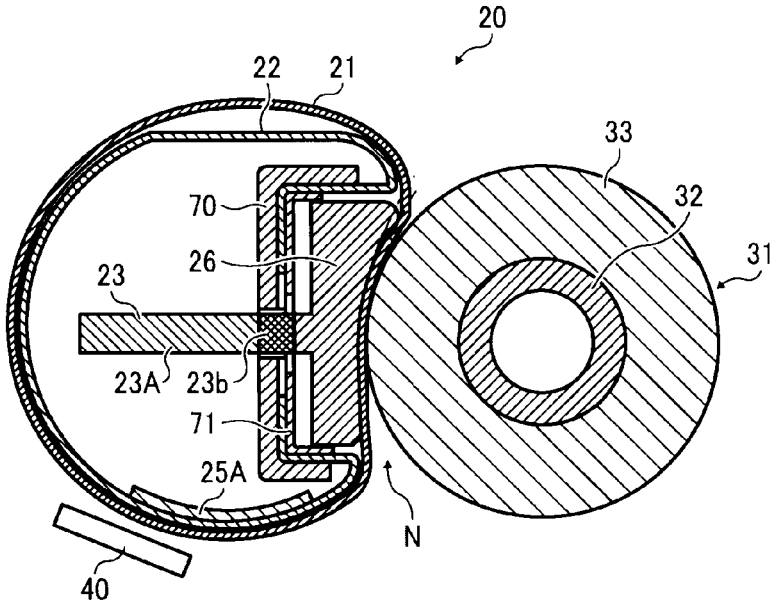
FIG. 10 is an end-on, axial cutaway view of the fixing device according to another embodiment of this patent specification.

FIG. 10 is an end-on, axial cutaway view of the fixing device 20 according to another embodiment of this patent specification.

As shown in FIG. 10, the overall configuration of the fixing device 20 is similar to that depicted in FIG. 2, except that the present embodiment employs a planar resistive heater 25A, that transmits heat at least by conduction to the heat pipe 22, instead of a radiant heater.

Specifically, the planar resistive heater 25A is attached to the inner circumferential surface of the heat pie 22 upstream from the fixing nip N in a circumferential, rotational direction in which the fuser belt 21 rotates around the heat pipe 22 (i.e., counterclockwise in FIG. 10), so as to conduct heat to the heat pipe 22 to in turn heat the entire length of the fuser belt 21 during rotation.

Figure 11:
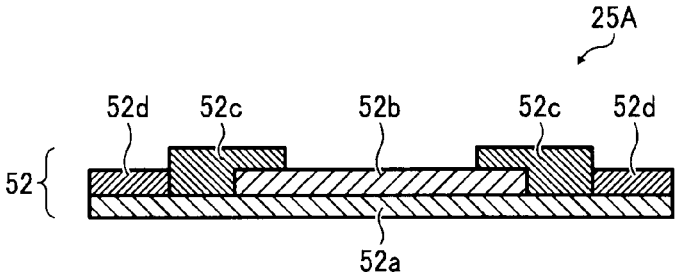
FIG. 11 is a cross-sectional view of an example of the planar resistive heater employed in the fixing device of FIG. 10.

With additional reference to FIG. 11, which is a cross-sectional view of an example of the planar resistive heater 25A, the heater 25A is shown including a laminated heat generator 52 formed of a resistive heating layer 52*b* of heat-resistant material with conductive particles dispersed therein, and an electrode layer 52*c* for supplying electricity to the resistive layer 52*b*, which are deposited adjacent to each other upon an electrically insulative substrate 52*a* to together form a heating circuit that generates heat for conduction to the heat pipe 22. An insulation layer 52*d* is disposed to separate the resistive layer 52*b* from adjacent electrode layers of other heating circuits while isolating edges of the generator 52 from external components. A set of electrode terminals may also be provided at opposed longitudinal ends of the generator 52 to conduct electricity from wiring to the heating circuitry.

More specifically, in the present embodiment, the heat generator 52 as a whole is a thin, flexible sheet dimensioned according to the axial and circumferential dimensions of the fuser belt 21, approximately 0.1 mm to approximately 1 mm thick, which exhibits a relatively low heat capacity for allowing immediate heating, as well as a certain flexibility for conforming to the curved configuration of the fuser belt 21 when assembled.

The substrate 52*a* of the heat generator 52 is a thin, elastic film of heat-resistant resin such as polyethylene terephthalate (PET), and preferably, polyimide resin for obtaining sufficient heat-resistance, electrical insulation, and flexibility.

The resistive heating layer 52*b* is a thin, conductive layer of composite material that exhibits a certain resistivity so as to generate Joule heat when supplied with electricity. For example, the resistive heating layer 52*b* may be a thin, conductive film of a heat-resistant resin such as polyimide containing uniformly dispersed particles of conductive material, such as carbon or metal, obtained by coating the substrate 52*a* with a precursor of heat-resistant resin mixed with a dispersion of conductive material. Alternatively, instead, the resistive heating layer 52*b* may be a laminated layer of heat-resistant material and conductive material, obtained by coating the substrate 52*a* initially with a conductive layer and then with a metal layer deposited thereon.

The electrode layer 52*c* may be obtained by depositing a paste of conductive material, such as conductive ink or silver, or by attaching a foil or mesh of metal to the surface of the substrate 52*a*. The insulating layer 52*d* may be obtained by depositing the same insulating material used to form the substrate 52*a*, such as polyimide resin.

Using such a planar heating element 25A instead of a radiant heater allows direct, immediate transmission of heat to the circumferential surface of the heat pipe 22 to effectively heat the heat pipe 22, leading to energy-efficient, fast fixing process with reduced warm-up time and first-print time required to process a print job.

In further embodiment, the planar resistive heater 25A may be used in conjunction with a tubular, cylindrical belt holder, instead of a heat pipe. Such a belt holder comprises a thin-walled pipe formed of metal, such as iron or stainless steel, approximately 0.1 mm to approximately 1 mm thick, and having an outer diameter approximately 0.5 mm to approximately 1 mm smaller than the inner diameter of the fuser belt 21 in its generally cylindrical configuration, with an elongated slit or window cut in the wall of the tubular body, upstream from the fixing nip N in the circumferential direction.

In such cases, the resistive heater 25A is accommodated within the tubular belt holder, while exposed to outside through the window in the tubular body to meet the inner circumferential surface of the fuser belt 21 sliding against the outer circumferential surface of the belt holder. Direct contact thus established between the resistive heater 25A and the fuser belt 21 allows for efficient, immediate heating of the fuser belt 21.

Alternatively, instead of with a heat pipe or a belt holder, the resistive heater 25A may be employed in combination with a heater support provided inside the loop of the fuser belt 21, upstream from the fixing nip N in the circumferential direction. Such a heater support has its outer circumferential surface shaped into a curved configuration along which the fuser belt 21 can rotate while maintaining its generally cylindrical configuration.

In such cases, the resistive heater 25A is attached to the curved outer surface of the heater support, so that the fuser belt 21 slides against the resistive heater 25A during rotation. For higher durability against wear and tear due to sliding contact with the fuser belt 21, the resistive heater 25A may be provided with a coating of lubricant, such as fluorine resin, over the resistive heating layer 52*b*. Also, for higher thermally efficiency in heating the fuser belt 21, the heater support may be formed of thermally insulative material, such as sponged silicone rubber or other suitable resin, which prevents dissipation of heat from the resistive heater 25A to the heater support.

Figure 12:
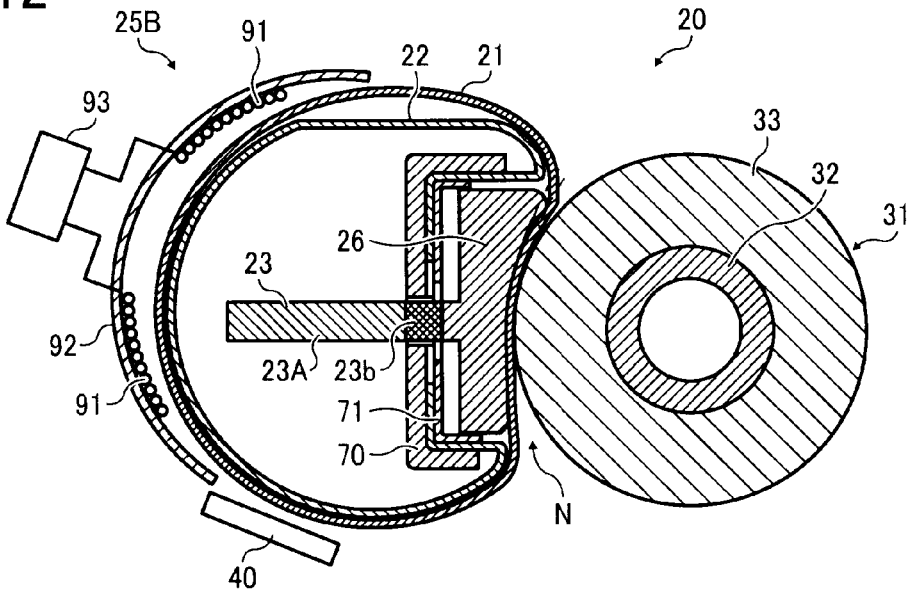
FIG. 12 is an end-on, axial cutaway view of the fixing device according to still another embodiment of this patent specification.

FIG. 12 is an end-on, axial cutaway view of the fixing device 20 according to still another embodiment of this patent specification.

As shown in FIG. 12, the overall configuration of the fixing device 20 is similar to that depicted in FIG. 2, except that the present embodiment employs an induction heater 25B that generates heat through electromagnetic induction, instead of a radiant heater.

Specifically, the induction heater 25B comprises an elongated structure extending across the fuser assembly outside of the loop of the fuser belt 21, consisting of an arc-shaped core 92 formed of a ferromagnetic material with high electrical resistivity, such as ferrite or permalloy, along which a plurality of electromagnetic coils or Litz wires 91 each being a wound bundle of thinner wires extend in the axial direction, combined with a power unit or inverter 93 for supplying electricity to the coils 91. The induction heater 25B generates an alternating magnetic field around the heat pipe 22 to in turn induce eddy currents over the surface of the heat pipe 22, which exhibits certain electrical resistivity to produce a corresponding amount of Joule heat.

For preventing the fuser belt 21 and the heat pipe 22 from overheating due to electromagnetic induction, in particular, at the longitudinal ends of the fuser assembly outboard of a width of the recording sheet S, the heat pipe 22 may be formed of a magnetic shunt alloy, such as Fe—Ni alloy, which exhibits a specific Curie temperature of approximately 140° C. to approximately 200° C., comparable to an operational temperature with which the fixing device processes a toner image.

The fixing device 20 according to this patent specification can process a recording sheet S with good imaging quality and conveyance performance, without image defects due to variations in pressure across the fixing nip and failures caused by winding the recording medium around the fuser member or the pressure member, owing to provision of the fuser pad 26 with the generally concave peripheral surface. The image forming apparatus 1 according to this patent specification also benefits from various effects obtained with the fixing device 20 incorporated therein.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable, flexible fuser belt looped into a generally cylindrical configuration;

a heater disposed adjacent to the fuser belt to heat the fuser belt;

a fuser pad disposed inside the loop of the fuser belt; and a pressure member disposed opposite the fuser pad with the fuser belt interposed between the fuser pad and the pressure member, the pressure member pressing in a load direction against an outer peripheral surface of the fuser pad through the fuser belt to form a fixing nip therebetween, through which a recording medium travels in a conveyance direction under heat and pressure;

the fuser pad including, along the outer peripheral surface thereof, a protruding portion and a second portion adjoining the protruding portion to face an outer circumferential surface of the pressure member, the protruding portion extending outside of and downstream from the fixing nip in the conveyance direction to protrude toward the pressure member while remaining out of contact with the outer circumferential surface of the pressure member, and a planar portion adjoining the second portion along the outer surface of the fuser pad and on an upstream side of the fixing nip in the conveyance direction, at least a part of the planar portion being separated from the outer circumferential surface of the pressure member.

2. The fixing device according to claim 1, wherein an end of the planar portion is shaped into a chambered or beveled edge.

3. The fixing device according to claim 1, wherein the fuser pad comprises a resin material.

4. The fixing device according to claim 1, wherein the second portion is inwardly curved.

5. The fixing device according to claim 4, wherein the fuser pad further includes an additional inwardly curved portion having a radius of curvature different from that of the inwardly curved portion, and adjoining the inwardly curved portion along the outer surface of the fuser pad, wherein the additional inwardly curved portion extends over an upstream side, opposite the downstream side, of the fixing nip in the conveyance direction.

6. The fixing device according to claim 5, wherein the radius of curvature of the additional inwardly curved portion is greater than that of the inwardly curved portion.

7. The fixing device according to claim 4, wherein an upstream end of the inwardly curved portion is located downstream from a center of the fixing nip in the conveyance direction.

8. The fixing device according to claim 4, wherein the inwardly curved portion in cross section defines an inward curve that has a radius of curvature ranging from approximately 25 millimeters to approximately 60 millimeters.

9. The fixing device according to claim 4, wherein a distance, in a radial direction of the inwardly curved portion, between a downstream end of the fixing nip and a vertex of the protruding portion falls within a range between approximately 0.1 millimeters to approximately 0.2 millimeters.

10. The fixing device according to claim 1, wherein the planar portion extends over an upstream side, opposite the downstream side, of the fixing nip in the conveyance direction.

11. The fixing device according to claim 1, wherein the protruding portion in cross section defines an arc of a circle with a specific radius of curvature.

12. The fixing device according to claim 1, wherein a distance, in the conveyance direction of the recording medium, between a downstream end of the fixing nip and a vertex of the protruding portion falls within a range between approximately 1 millimeter to approximately 2 millimeters.

13. The fixing device according to claim 12, wherein the fuser belt includes a substrate formed of at least one of stainless steel, nickel, and polyimide.

14. The fixing device according to claim 12, wherein the substrate of the fuser belt is from approximately 20 micrometers to approximately 35 micrometers in thickness.

15. The fixing device according to claim 1, further comprising a tubular heat pipe around which the fuser belt is entrained, so that the fuser belt rotates in its generally cylindrical configuration around the heat pipe while heated by conduction from the heat pipe except at the fixing nip.

16. The fixing device according to claim 15, wherein the heat pipe comprises a generally cylindrical body of metal.

17. The fixing device according to claim 15, wherein the heater is disposed inside the heat pipe to heat the heat pipe to in turn heat the fuser belt through conduction.

18. The fixing device according to claim 1, further comprising a reinforcing member disposed in contact with the fuser pad inside the loop of the fuser belt to restrict displacement of the fuser pad at least in the load direction.

19. The fixing device according to claim 1, further comprising a sheet of lubricant material for covering the fuser pad.

20. The fixing device according to claim 1, wherein the heater comprises a radiant heater that transmits heat at least by radiation.

21. The fixing device according to claim 1, wherein the heater comprises a planar resistive heater that transmits heat at least by conduction.

22. The fixing device according to claim 1, wherein the heater comprises an induction heater that generates heat through electromagnetic induction.

23. The fixing device according to claim 1, wherein the planar portion forms the fixing nip together with the pressure member.

24. The fixing device according to claim 1, wherein a pressure between the fuser belt and the pressure member is variable.

25. The fixing device according to claim 24, wherein the pressure member is movable to change the pressure between the fuser belt and the pressure member.

26. The fixing device according to claim 1, wherein the fixing device is a vertical conveyance fixing device.

27. The fixing device according to claim 1, wherein the pressure member includes a sponge roller.

28. The fixing device according to claim 27, wherein the sponge roller includes sponged silicone rubber.

29. A fixing device comprising:

a rotatable, flexible fuser belt looped into a generally cylindrical configuration;

a heater disposed adjacent to the fuser belt to heat the fuser belt;

a fuser pad disposed inside the loop of the fuser belt; and a pressure member disposed opposite the fuser pad with the fuser belt interposed between the fuser pad and the pressure member, the pressure member pressing in a load direction against an outer peripheral surface of the fuser pad through the fuser belt to form a fixing nip therebetween, through which a recording medium travels in a conveyance direction under heat and pressure, wherein the fuser pad includes, along the outer peripheral surface thereof, a protruding portion extending outside of and downstream from the fixing nip in the conveyance direction to protrude toward the pressure member while remaining out of contact with the outer circumferential surface of the pressure member, and a planar portion extending at least upstream from the fixing nip in the conveyance direction to face an outer circumferential surface of the pressure member, and at least a part of the planar portion separates from the outer circumferential surface of the pressure member.

30. The fixing device according to claim 29, wherein an end of the planar portion is shaped into a chambered or beveled edge.

31. The fixing device according to claim 29, wherein the fuser pad comprises a resin material.

32. The fixing device according to claim 29, wherein a second portion, which adjoins the protruding portion and the planar portion is inwardly curved.

33. The fixing device according to claim 29, wherein the planar portion forms the fixing nip together with the pressure member.

* * * * *